United States Patent [19]

Amato

[11] Patent Number: 4,465,270

[45] Date of Patent: Aug. 14, 1984

[54] APPARATUS FOR HANDLING SINGLE SHEETS DELIVERED IN SUCCESSION

[76] Inventor: Gloria Amato, Via Roma 135 P, Prato, Firenze, Italy

[21] Appl. No.: 412,991

[22] Filed: Aug. 30, 1982

[30] Foreign Application Priority Data

Sep. 8, 1981 [IT] Italy ..... 9510 A/81

[51] Int. Cl.[3] ..... B65H 43/04

[52] U.S. Cl. ..... 271/198; 271/216; 271/217

[58] Field of Search ..... 271/198, 202, 203, 213, 271/214, 215, 216, 217

[56] References Cited

U.S. PATENT DOCUMENTS 3,772,971 11/1973 Dutro ..... 271/217 X 3,830,144 8/1974 Kuckhermann ..... 271/215 X

*Primary Examiner*—Richard A. Schacher

*Attorney, Agent, or Firm*—McGlew and Tuttle

[57] ABSTRACT

Apparatus for handling single sheets delivered in succession from upstream equipment comprises two conveyors, the first of which is adapted to receive the sheets and is actuated independently of upstream equipment, at an adjustable speed, either higher or lower, than that of the arriving sheets. The second conveyor is mounted on a vertically-movable structure and is able to reach a raised position substantially level with the first conveyor, in which position it engages a gear for actuation synchronously with the first conveyor, or several positions progressively lower, in which the second conveyor is stopped in a condition to effect stacking of the sheets.

4 Claims, 6 Drawing Figures

APPARATUS FOR HANDLING SINGLE SHEETS DELIVERED IN SUCCESSION

BACKGROUND OF THE INVENTION (1) Field of the Invention

The present invention relates to apparatus for handling single sheets fed in succession from sheet feed means.

(2) Description of the Prior Art

Equipment which delivers single sheets of paper or the like in succession, for example computer printout equipment in which continuous computer stationery is torn into individual sheets, is commonly associated with means for stacking the sheets. Alternatively, provision may be made for continuous transfer of the sheets for further processing. The stacking means or continuous transfer means are normally controlled by the upstream equipment, via a mechanical transmission which provides speeds related to the operation of the upstream equipment.

SUMMARY OF THE INVENTION

According to the invention, there is provided apparatus for handling single sheets fed in succession from sheet feed means, said apparatus comprising first conveyor means arranged to receive sheets from the sheet feed means, said first conveyor means being driven independently of the sheet feed means, second conveyor means arranged to receive sheets discharged from the first conveyor means, means mounting the second conveyor means for vertical movement between a raised position in which the second conveyor means is substantially level with the first conveyor means and successive lowered positions in which the second conveyor means permits sheets discharged from the first conveyor means to accumulate in a stack, and means for establishing a drive transmission from the first conveyor means to the second conveyor means when the second conveyor means is in its raised position whereby the second conveyor means is actuated in synchronism with the first conveyor means, said drive transmission being broken in the lowered positions whereby the second conveyor means is stopped during stacking.

In a preferred embodiment, the drive transmission between the first and second conveyor means is provided by two gears on the two conveyor means and an idle wheel.

For control of stacking, the apparatus preferably comprises a photocell sight, or the like, able to be intercepted by the stack under formation to control on every interception a lowering of the second conveyor means in unit steps.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
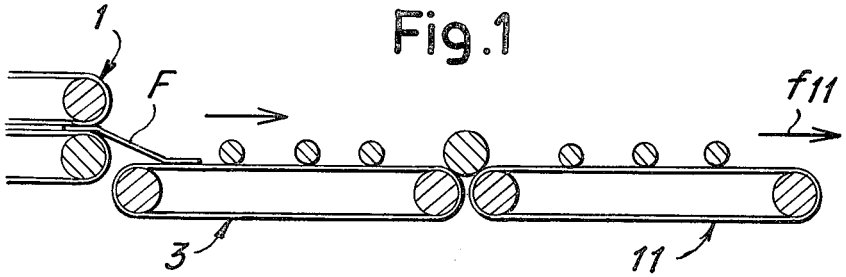
FIGS. 1 and 2 show, respectively, in side view and plan view, sheet handling apparatus in accordance with the invention set up to provide for direct feeding of the sheets for further processing.
Figure 3:
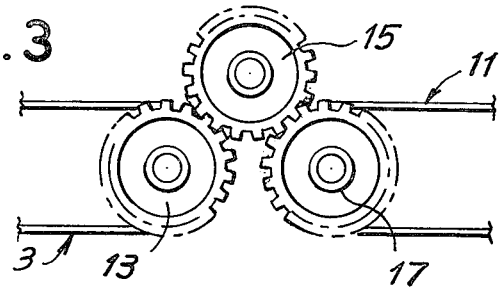
FIG. 3 shows an enlarged detail of FIG. 1.
Figure 2:
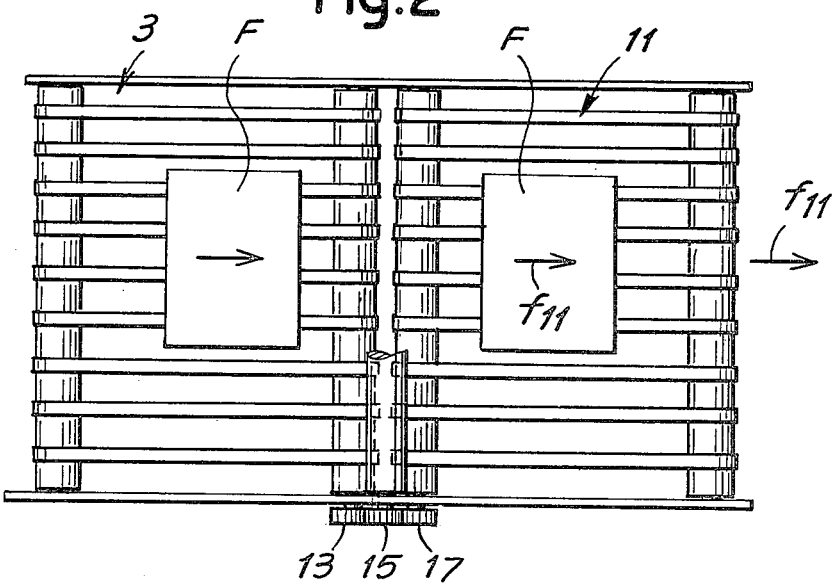

As illustrated in the drawing, 1 denotes the delivery end portion of a paper tearer in computer printout equipment or of the other equipment which delivers individual sheets F, the delivery end portion including fast rollers for projecting the sheets.

The sheet handling apparatus according to the preferred embodiment of the invention comprises a structure which, as shown, is independent of but may be associated with the equipment, downstream of same. The apparatus comprises a continuous conveyor 3 for example having multiple belts or the like, which is driven by a motor independent of the equipment 1 and which may be regulable in appropriate manner, advantageously through the use of a DC electric motor with potentiometer. Thus, the conveyor 3 may be actuated at a speed higher or lower than that of delivery speed of the sheets F from the equipment 1.

Figure 6:
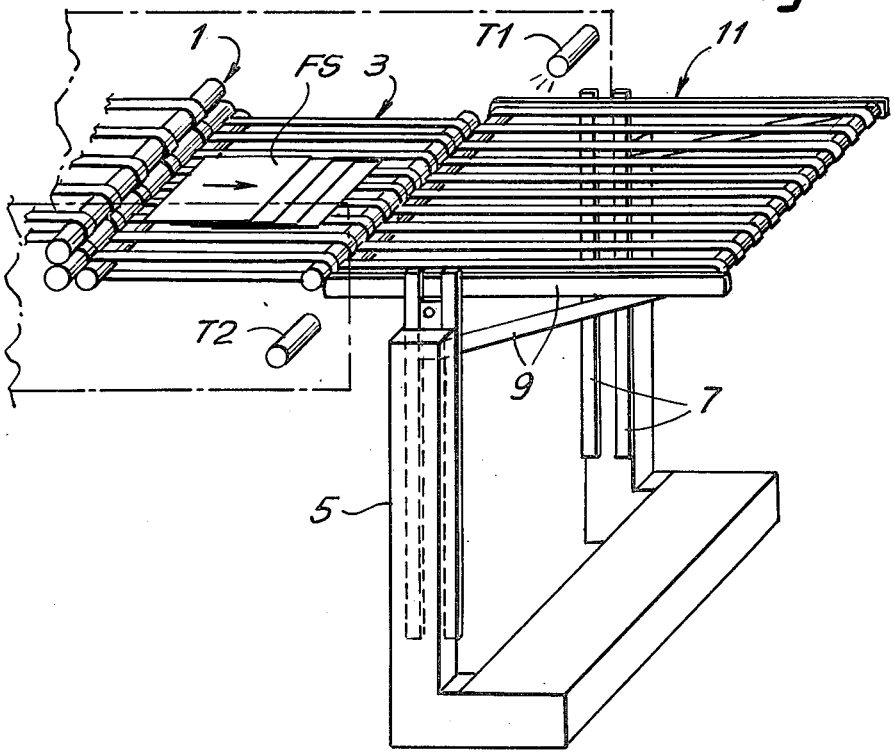
FIG. 6 is a perspective view of the apparatus.

As shown in FIG. 6, guides 7 forming part of a movable assembly generally denoted by 9, are able to run vertically on guiding means 5 of the structure of the apparatus under consideration. The assembly 9 carries a second continuous conveyor 11 with belts or the like. Both conveyors 3 and 11 have a substantially horizontal run. Conveyor 11 may be raised up to substantially the level of the conveyor 3 (FIG. 1) with which it is contiguous. In this position a transmission comprising gears 13, 15 and 17 transmits drive from the conveyor 3 to the conveyor 11, the gear 15 being an idle gear 15 with which the gear 17 actuating the conveyor 11 engages. In this position, therefore, sheets F spaced at a distance one from another (through the speed of the cnveyors 3 and 11 being increased relative to the speed of delivery of the equipment 1) are transferred and moved in the direction of arrows f11 for subsequent processing, one independently of another.

Figure 4:
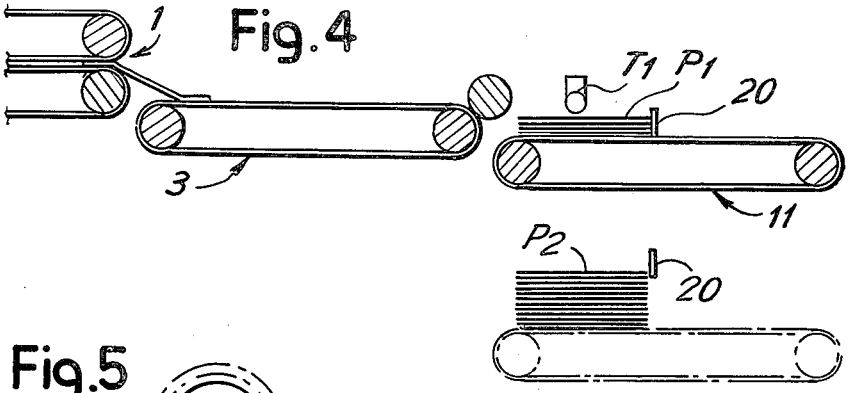
FIG. 4 is a view similar to FIG. 1, but showing the apparatus set up for stacking the sheets.
Figure 5:
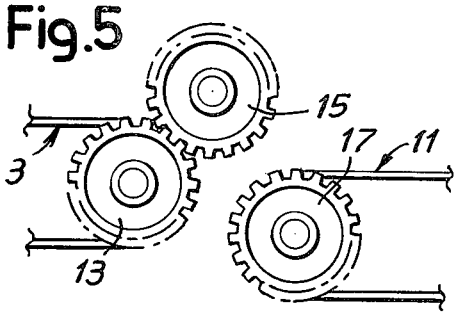
FIG. 5 is an enlarged detail of FIG. 4.

When stacking is to be effected, the assembly 19 is lowered along the guiding means 5 by a suitable control device, for example comprising chains controllable stepwise or threaded rod couplings. The assembly 9 is lowered from the raised position described hereinabove by a limited amount, and is stopped due to disengagement of the coupling between the gears 15 and 17; the conveyor 3 is slowed down in such a manner that the sheets F become partly juxtaposed as is shown in FIG. 6 by $F_S$, i.e. with overlaps. The sheets $F_S$ are despatched by the conveyor 3 onto the conveyor 11, the front edge $F_S$ of each sheet abutting against a flange 20 disposed at a suitable height. Under these conditions, the sheets discharged from the conveyor 3 form a stack P as denoted by P1 in FIG. 4. On the structure of the assembly there is arranged an optical sight, formed, for example, by a projector T1 and a receiver T2, disposed at such a level that the stack under formation intercepts the sight when it has reached a certain thickness. When the sight is intercepted, the assembly 9 is lowered again through a distance such as to keep the flange 20 at a position operative to stop the sheets discharged onto the stack being formed. With the growth of the stack under formation there are effected in the same manner as described above successive lowerings by increments of the assembly 9 and of the stack under formation, until the desired thickness of the stack has been fully reached.

For the formation of a new stack, after the one that has been formed has been removed, the assembly 9 is returned upwards so that the conveyor 11 reaches a position below that at which the two conveyors are in driving engagement, to resume the cycle. Provision may alternatively be made for the lifting of the assembly 7 to the engaged position of the two conveyors, followed by a predetermined and limiting lowering.

The apparatus particularly described is able to function either to continuously feed the paper sheets, or to stack the sheets, as desired.

What is claimed is:

1. Apparatus for handling single sheets fed in succession from sheet feed means, said apparatus comprising first conveyor means arranged to receive sheets from the sheet feed means, said first conveyor means being driven independently of the sheet feed means, second conveyor means arranged to receive sheets discharged from the first conveyor means, means mounting the second conveyor means for vertical movement between a raised position in which the second conveyor means is substantially level with the first conveyor means and successive lowered positions in which the second conveyor means permits sheets discharged from the first conveyor means to accumulate in a stack, and means for establishing a drive transmission from the first conveyor means to the second conveyor means when the second conveyor means is in its raised position whereby the second conveyor means is actuated in synchronism with the first conveyor means, said drive transmission being broken in the lowered positions whereby the second conveyor means is stopped during stacking.

2. Apparatus according to claim 1, wherein the first conveyor means is driven at an adjustable speed so that the first conveyor means operates selectively at a speed higher or lower than that of the sheet feed means.

3. Apparatus according to claim 2, wherein the means for establishing a drive transmission from the first conveyor means to the second conveyor means comprises a first gear wheel driven in synchronism with the first conveyor means, a second gear wheel for driving the second conveyor means and movable vertically with the second conveyor means, and an idle wheel operatively connecting the first and second gear wheels when the second conveyor means is in its raised position.

4. Apparatus according to claim 1, or claim 2, or claim 3, further comprising means for sensing the height of a stack being formed to thereby control lowering of the second conveyor means.

* * * * *